US007555790B2

(12) United States Patent
Ostrander

(10) Patent No.: US 7,555,790 B2
(45) Date of Patent: Jul. 7, 2009

(54) NURSING COVER

(76) Inventor: Charlotte Ostrander, 500 Capitol Dr., Benicia, CA (US) 94510

( * ) Notice: Subject to any disclaimer, the term of this patent is extended or adjusted under 35 U.S.C. 154(b) by 0 days.

(21) Appl. No.: 12/035,314

(22) Filed: Feb. 21, 2008

(65) Prior Publication Data

US 2008/0201817 A1 Aug. 28, 2008

Related U.S. Application Data

(60) Provisional application No. 60/902,993, filed on Feb. 22, 2007.

(51) Int. Cl.
*A41D 1/20* (2006.01)
*A41D 13/04* (2006.01)

(52) U.S. Cl. ..... 2/104; 2/48; 2/52

(58) Field of Classification Search ..... 2/104, 2/48, 88, 51, 49.1–49.5, 52, 50, 46, 336, 2/338, 312, 207, 92, 114, 69, 69.5, 105; D2/860–864, D2/823
See application file for complete search history.

(56) References Cited

U.S. PATENT DOCUMENTS

| | | | | | |
|---|---|---|---|---|---|
| 1,657,868 | A | * | 1/1928 | Segal | 2/52 |
| 1,951,380 | A | * | 3/1934 | Wagenfeld | 2/52 |
| 2,366,393 | A | * | 1/1945 | Geisinger | 2/52 |
| 2,423,002 | A | * | 6/1947 | Bray | 2/52 |
| 2,567,524 | A | * | 9/1951 | Morganti | 2/48 |
| 4,014,045 | A | * | 3/1977 | Moyer | 2/51 |
| 4,106,122 | A | | 8/1978 | Dodd | |
| 4,468,816 | A | | 9/1984 | Kaufer | |
| 4,711,409 | A | * | 12/1987 | Jones | 242/382.4 |
| D294,536 | S | | 3/1988 | Welsh | |
| 5,090,059 | A | | 2/1992 | Kahl | |
| 5,479,662 | A | | 1/1996 | Runco | |
| 5,592,692 | A | * | 1/1997 | Larson | 2/104 |
| 5,652,958 | A | | 8/1997 | Farrell-Mestas | |
| 5,893,171 | A | | 4/1999 | Ries | |
| 5,956,762 | A | | 9/1999 | Adams | |
| 6,216,273 | B1 | | 4/2001 | Williams | |

(Continued)

FOREIGN PATENT DOCUMENTS

| | | |
|---|---|---|
| EP | 1322193 | 10/2001 |

(Continued)

OTHER PUBLICATIONS

Bebe au Lait; http://www.bebeaulait.com/product.html, as accessed on Jan. 25, 2007. 1 page.

(Continued)

*Primary Examiner*—Amy B Vanatta
(74) *Attorney, Agent, or Firm*—Thorpe North & Western LLP

(57) ABSTRACT

A cover for shielding the upper front portion of a mother and nursing infant can include a panel of fabric and at least one fastening mechanism. The panel of fabric can have a height and width sufficient to substantially cover at least a region from the mother's upper chest to below the mother's breasts. A neck fastening strap can be attached to the upper edge of the panel for securing the panel to the mother's neck. A back fastening strap can be attached to a side edge of the panel of fabric and configured to optionally attach to the opposite side edge of the panel of fabric.

11 Claims, 4 Drawing Sheets

U.S. PATENT DOCUMENTS

| | | | | |
|---|---|---|---|---|
| 6,216,274 | B1 | 4/2001 | Harris | |
| 6,865,749 | B2 * | 3/2005 | Mohney | 2/48 |
| 7,114,191 | B1 | 10/2006 | Butler-Penenberg | |
| 7,188,372 | B2 | 3/2007 | Stockard | |
| 7,255,436 | B2 * | 8/2007 | Tracy | 2/209.13 |
| 7,406,718 | B2 | 8/2008 | Ekelund et al. | |
| 7,409,727 | B2 | 8/2008 | Ekelund et al. | |
| 2004/0199977 | A1 * | 10/2004 | Stockard | 2/104 |
| 2005/0279797 | A1 * | 12/2005 | Martin et al. | 224/637 |
| 2007/0050885 | A1 | 3/2007 | Steinert | |
| 2007/0094764 | A1 | 5/2007 | Wakefield et al. | |
| 2007/0151000 | A1 | 7/2007 | Gates | |
| 2007/0214549 | A1 | 9/2007 | Carr | |
| 2008/0034462 | A1 * | 2/2008 | Ekelund et al. | 2/104 |

FOREIGN PATENT DOCUMENTS

| | | |
|---|---|---|
| JP | 3087648 | 5/2002 |
| KR | 0327707 | 9/2003 |

OTHER PUBLICATIONS

How to use & care for your Nursing Cover, Bebe au Lait; http://www.bebeaulait.com/use.html, as accessed on Jan. 25, 2007, 2 pages.

Nursing Covers; Nurisng Mommies Love their Modest Mommy Nursing Covers: The Modest Mommy Nursing Cover, http://www.modestmommycover.com/nursing-cover.html; as accessed on Jun. 2, 2008. pp. 1-10.

hide-and-peek; What is hide-and-peek?, http://www.hide-and-peek.com/, as accessed on Jan. 25, 2007; 1 page.

hide-and-peek; how to use your hide-and-peek; http://www.hide-and-peek.com/use&care.html, as accessed on Jan. 25, 2007. 1 page.

hide-and-peek; helpful hints & tips; http://www.hide-and-peek.com/tips&hints.html, as accessed on Jan. 25, 2007. 1 page.

How it works, a step-by-step guide; lila bean, http://www.lilabean.net/site/downpage.php?NodeID=10, as accessed on Jan. 31, 2007. p. 1-3.

Nursing Covers; lila bean, fabric choice, http://www.lilabean.net/site/downpage.php?NodeID=11, as accessed on Jan. 31, 2007. pp. 1-3.

Milkdudz, not your mommaz nursing wear; http://www.milkdudz.com/convertible_landing.html; as accessed on Jan. 25, 2007; 1 page.

Milkdudz, not your mommaz nursing wear; The Original Babymina, http://www.milkdudz.com/original_landing.html, as accessed on Jan. 25, 2007, 1 page.

Milkdudz, not your mommaz nursing wear, The Convertable BabyMina-Greenwich Place, http://www.milkdudz.com/product_details.php?UPC=30015, as accessed on Jan. 25, 2007. p. 1-2.

Milkdudz, not your mommaz nursing wear; The Original BabyMina-Strawberry Fields; http://www.milkdudz.com/product_detailsphp?UPC=30008; as accessed on Jan. 25, 2007. p. 1-2.

This season's featured style Nursing Aprons, Grace Allaiter Nursing Apparel; http://www.gracemama.com/index.html; as accessed on Jan. 25, 2007; 1 page.

Cover. Nurse. Relax. http://www.nursingcovers.blogspot.com. As accessed on May 28, 2008. p. 1-17.

Baby Hide Away Nursing Covers. http://www.babyhideaway.blogspot.com/. As accessed on May 28, 2008. p. 1-18.

Cutie Covers. http:// www. cutiecovers.blogspot.com/. As accessed on May 28, 2008. p. 1-26.

Generation Baby. http://www.generationbaby.ca/. As accessed on May 28, 2008. p. 1-4.

Peanut Shell: The pouch style baby sling, nursing cover, and baby wrap for fashionable . . . http://www.goo-ga.com/ As accessed on May 28, 2008. p. 1-2.

The Peanut Shell Baby Sling; Fashionably Functional Baby Slings; http://www.goo-ga.com/productinfo/nursing. As accessed on May 28, 2008. p. 1-3.

Nursing Nanny. http://www.nursingnanny.com/. As accessed on May 28, 2008. 1 page.

Loper Land: Baby and Mom Products-Nursing Nanny Breastfeeding Cover. http://www.loperland.com/index.php?act=act=viewProd&productId=13. As accessed on May 28, 2008. p. 1-4.

Monkey Foot Designs. Nursing cover, nursing apron, breastfeeding cover, breastfeeding apron. http://mokeyfootdesigns.com/catalog.php?category=23. As accessed on May 28, 2008. 1 page.

The Pitter Patter Boutique. Custom Handmade Nursing Covers (Breastfeeding Cover-Ups) http://thepitterpatterboutique.com/category-6/Nursing-Covers.htm. As accessed on May 28, 2008. p. 1-2.

Girly Glam Boutique. http://www.girlyglamboutique.com/catalog.htm?keyword=breastfeeding+cover&cond=adv...As accessed on May 28, 2008. p. 1-4.

Hawaiian Style Apron Co. LLC. Aprons with a Little Hawaiian Styly! http://www.hawaiianstyleapronco.com/category.sc?categoryId=2. As accessed on May 28, 2008. p. 1-2.

Sun Protective Nursing Cover. http://www.sweetots.com/servlet/the-36/Sun-Protective-Nursing-Cover/Detail. As accessed on May 28, 2008. p. 1-2.

Modest Mums. http://modestmums.com/catalog.php?category=1. As accessed on Jun. 2, 2008. p. 1-3.

Sasha b. design. Minky Nursing Covers. http://www.sashabdesigns.com/index.php?cat=1. As accessed on May 28, 2008. p. 1-3.

The Mother Cover. http://www.themothercover.com/products.htm. As accessed on May 28, 2008. 1 page.

Lola babiez Organics. Breastfeeding Covers. http://www.lolababiez.com/brcoups.html. As accessed on May 28, 2008. p. 1-2.

milkchic nursing covers-the flavorful nursing covers with style. http://www.milkchic.com/products.html. As accessed on May 28, 2008, p. 1-4.

Milk Mumu Nursing Covers. http://milkmumu.com/catalog.php?category=1. As accessed on May 28, 2008. p. 1-3.

Knocker Blocker "Cover Them Babies Up". http://www.knocerblocker.com/Products.html. As accessed on May 28, 2008. p. 1-3.

Nursing Undercover-Nursing Covers. http://www.nursingundercover.com/NursingCovers.shtml. As accessed on May 28, 2008. p. 1-3.

Nursing Covers by Rosanna. http://nursingcovers-byrosanna.blogspot.com. As accessed on Jun. 2, 2008. p. 1-7.

NLB Cotton Nursing Covers. http://www.newlittleblessing.com/store/index.php?main-page=index&cPath=1. As accessed on May 28, 2008. p. 1-5.

5 Little Piggies Marketplace. http://www.5littlepiggies.com/market/nursincovers. As accessed on May 28, 2008. p. 1-5.

Hiccup. Hiccup Shop: About Nursing Covers. http://hiccupshop.com/about-nc.php. As accessed on May 28, 2008. p. 1-4.

Simply-Bloom. http://www.simply-bloom.com/catalog.php?category=8. As accessed on Jun. 1, 2008. p. 1-8.

MooMoo fashionable nursing blankets. http://www.moomoomama.com/products.html. As accessed on May 30, 2008. 1 page.

Baby Time Nursing Covers SplendiDesigns.com. http://babytimenursingcover.com/default.aspx. As accessed on Jun. 2, 2008. p. 1-3.

Little qties Boutique Sweet Something for your little cuties. http://www.littleqties.com/item-6Reversible-Nursing-Cover.htm As accessed on May 30, 2008.

hide-and-peek. Hide-and Peek nursing cover. every hooter needs a hider! http://cgi.ebay.com/Hide-and-Peek-nursing-cover-every-hooter-needs-a-hider-WoQQitemZ320075990740QQihZ011QQcategoryZ204...As accessed on Jan. 31, 2007. p. 3-26.

Betty Labelle Unique Nursing Covers. http://www.bettylabelle.com/store/Default.asp. As accessed on Jun. 2, 2008. p. 1-5.

* cited by examiner

NURSING COVER

PRIORITY DATA

This application claims the benefit of U.S. Provisional Patent Application Ser. No. 60/902,993, filed on Feb. 22, 2007, which is incorporated herein by reference in its entirety.

BACKGROUND OF THE INVENTION

For some time, nursing mothers have had a difficult struggle in maintaining some modesty as they must nurse at times and in environments where they cannot, or simply do not want to, retreat to a more secluded place. For this purpose, mothers have attempted to cover themselves with numerous coverings or drapes, such as blankets, while nursing in more public areas.

There are many drawbacks and safety concerns in using blankets for cover. For one, the blanket covering may not provide adequate ventilation for the baby. Further, when using a blanket as covering, the blanket may not be secure and often has a tendency of slipping and revealing more than the nursing mother intends or desires. This situation is only exacerbated by a squirming infant or by a need to re-position or switch sides. Further, using blankets or other type covers often results in the safety of the child being compromised because the mother has her hands occupied trying to keep the blanket up and covering herself for privacy. Yet another concern is limited view of the nursing child, where such view is useful in order to help the child easily and properly latch on to the breast.

In response to these concerns, various types of shields have been created, which aim at protecting a nursing mother's privacy. Many of the shield designs have drawbacks, though. Often the designs do not account for different-sized mothers and infants. They are either one-size-fits-all, or only allow for limited size variability. Additionally, many designs in use do not provide the mother with a view of her child while still maintaining privacy. Another area not often addressed by the current designs is the tendency of covers to slip or open on the sides of the shields, thus reducing the overall privacy for the mother and child.

SUMMARY OF THE INVENTION

A nursing cover for shielding the upper front portion of a mother and a nursing infant can provide the nursing mother confidence that her privacy will be protected while nursing in public spaces. The nursing cover can include a panel of fabric with opposing upper and lower edges and opposing side edges. The panel can be configured to have a height and width sufficient to substantially cover at least the region of a mother's upper chest to below her breasts. To improve ventilation to the infant and allow the mother to view the infant prior to and during the nursing process, the panel can optionally include a portion of resiliently flexible material with a stiffness greater than the fabric of the panel and configured to prevent the upper edge of the panel from resting against the mother. The cover can optionally include a slide buckle and neck fastening strap, each attached to the upper edge of the panel and spaced a distance apart. The neck fastening strap can be configured to extend around the mother's neck and snuggly fit the slide buckle. Further, the nursing cover can optionally include a back fastening strap attached to one side edge of the panel of fabric and configured to optionally attach to the second flank edge of the panel of fabric. In one aspect, the back fastening strap can be continuously adjustable.

Consistent with the invention, a method for discretely nursing an infant can include providing a nursing cover as described herein, fastening the neck fastening strap and adjusting the cover to shield an upper front portion of a mother and the nursing infant, and nursing the infant under the shield of the cover.

There has thus been outlined, rather broadly, certain features of the invention so that the detailed description thereof that follows may be better understood, and so that the present contribution to the art may be better appreciated. Other features of the present invention will become clearer from the following detailed description of the invention, taken with the accompanying claims, or may be learned by the practice of the invention.

Figure 1:
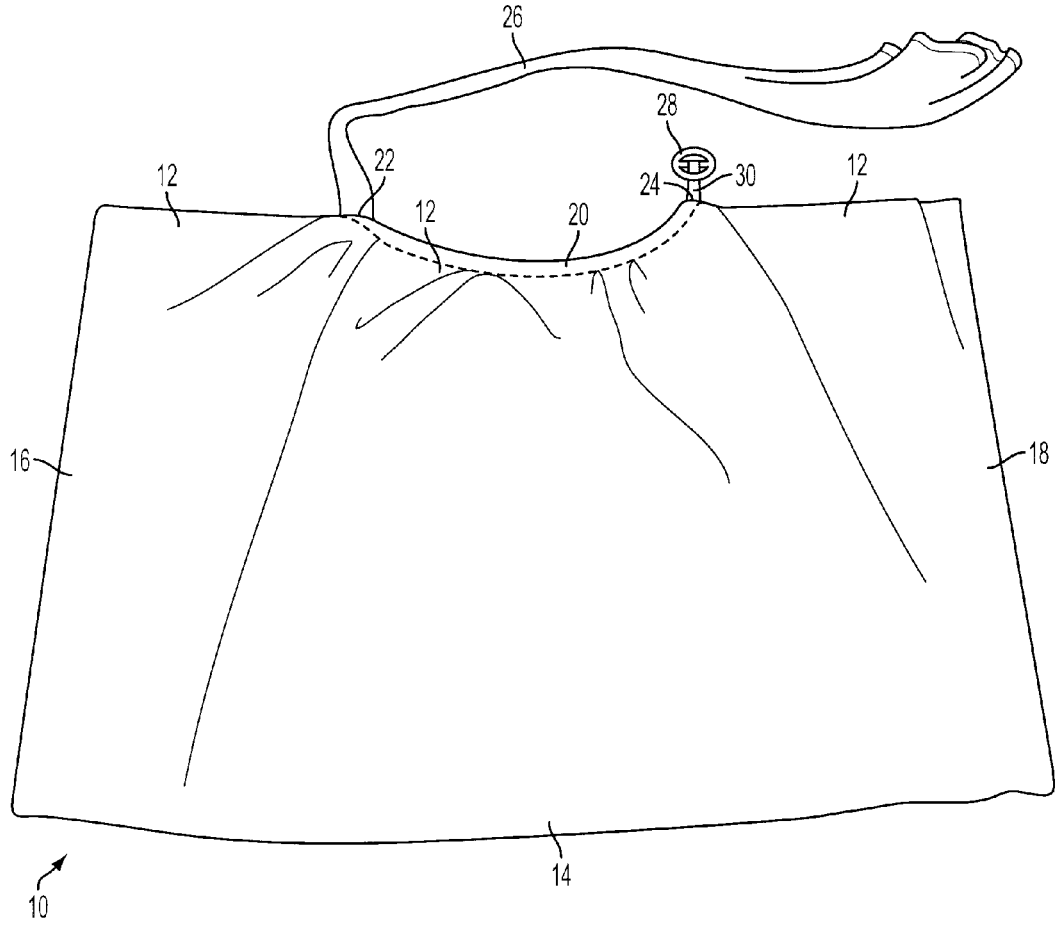
FIG. 1 is a perspective view of a nursing cover as resting against a flat surface, in accordance with one embodiment.

The drawings will be described further in connection with the following detailed description. Further, these drawings are by way of illustration only such that dimensions and geometries can vary from those illustrated.

DETAILED DESCRIPTION OF THE PREFERRED EMBODIMENT(S)

Reference will now be made to the exemplary embodiments of the present invention, both those described and those illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

In describing and claiming the present invention, the following terminology will be used.

The singular forms "a," "an," and "the" include plural referents unless the context clearly dictates otherwise. Thus, for example, reference to "a strap" includes reference to one or more straps.

The term "about" when referring to a numerical value or range is intended to encompass the values resulting from experimental error or differences in perception that can occur when taking measurements.

As used herein, the term "snuggly" or "snug" in reference to a buckle fit is a fit or state that is sufficient to prevent unintentional slippage of the strap or fit during use.

Unless otherwise indicated, the term "edge" refers to a border or outer perimeter and the area adjacent to it. In most instances, the edges can meet to form a point (e.g., upper edge and side edge of a rectangular figure). However, edges can also be distinct portions of a continuous edge having curved corners or contours.

Further, a "central region" or "located centrally on an edge" refers to portions of the edge that are near the center of a defined edge when compared to the area where two edges form a point. As such, located centrally is not located on or immediately near a corner.

The term "continuously adjustable," when referring to fastening means, refers to a state wherein two sides of a panel are attached by the fastening strap and the fastening strap allows for immediate adjustability depending on pushing or pulling the two sides apart or together. In such case, the continuously adjustable fastening agent automatically reacts to the change in conditions. As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc. This same principle applies to ranges reciting only one numerical value. Furthermore, such an interpretation should apply regardless of the breadth of the range or the characteristics being described.

According to various aspects of the present invention, a nursing cover for shielding at least the upper front portion of a mother and at least a portion of a nursing infant can include a panel of fabric. The panel of fabric can be of any shape permitted it sufficiently covers substantially at least the region defined by a mother's upper chest to below the mother's breasts and from approximately one armpit to a mid portion of the mother. In one aspect, the panel of fabric can be rectangular. Such is the case shown in FIG. 1. As illustrated, the nursing cover 10 is primarily rectangular in shape and has four sides. For ease of discussion, the sides are defined according to intended placement on a mother. Therefore, the cover has a top or upper edge 12 and an opposing lower edge 14. The cover also has a first side edge 16 and a second side edge 18. Alternatively, the nursing cover can be contoured in shape, e.g. elliptical or circular, or may have rounded corners, or other shapes which provide sufficient coverage or include functional and/or aesthetic features to the nursing cover. The nursing cover can be contoured according to anticipated use (e.g., sitting, standing, larger children, etc.), and such contouring can be configured to provide more or less coverage in various areas.

The exact dimensions and shape of the fabric panel can vary according to the needs and wants of the mother. Any fabric type that can adequately form, either by itself or in combination with another fabric, a shield that can prevent viewing of the mother's exposed breast can be used. Non-limiting examples of fabrics that can be used alone or in combination include all types of natural and synthetic fabrics (e.g. wool, cotton, silk, rayon, etc.), plastic, vinyl, leather, and paper. That said, some fabrics may be preferred based on ease of use, season or temperature, cost factors, availability, ease of manufacture, comfort and feel for the mother, and even comfort and feel for the infant. In one aspect, the fabric panel can comprise or consist essentially of cotton. In one aspect, a disposable nursing cover can be created using a low-cost material, such as, e.g., a plastic sheet, robust paper product, etc.

The size of the cover, as mentioned, should be adequate to cover the region of a mother from her upper chest to below her breasts. Larger sizes may also be desired. For example, the cover could extend past the mother's waist and provide for a larger area of coverage. In one aspect, the panel may extend between the two side edges a distance that adequately covers the desired areas of the mother's chest when nursing an infant, for example, the area between arms and optionally accounting for extra room to tent an infant, or optionally additional distance to account for wiggles of the infant. In another aspect, the panel may extend beyond the front region of a mother and may extend a distance that can reach the mother's back region. In one aspect, the panel may extend a distance so as to overlap when enclosing a mother and infant, or may be configured to be a length such that the opposing side edges meet or nearly meet at least at one point when wrapped around a mother and nursing infant. Without limiting the possible size of the panel, in one aspect, the height of the panel (as measured from the upper edge to the lower edge) can range from about 10 inches to about 60 inches and more specifically from about 18 inches to about 30 inches. Again, without limiting the possible size of the panel, in one aspect, the length of the panel (as measured from one side edge to the opposite side edge) can range from about 15 inches to about 60 inches, and more specifically from about 20 inches to about 40 inches.

In one aspect, the cover can be reversible. In such cases, it may be desirable to use two different fabrics sewn or otherwise attached together. The different fabrics can be of the same or deferring fabric type and differing patterns and/or colors. Further, the panel can be embellished with decorative edging or other type attachments. The panel may also include slits to insert hands under the cover without compromising the privacy aspect, or pockets that can hold various baby or other accessories. In such cases, the mother may have the option to retain one or both arms under the nursing cover during use or of inserting one or both hand and optionally any or all length of an arm through the slits in the panel for use in preparation, during, and immediately following nursing. Optionally, items can be sewn or otherwise attached to the nursing cover, for example, attached to the fabric panel or a neck or back strap. Although any number of items that could be useful or desirable to a mother and/or infant could be used, non-limiting examples include toys, rattles, burp rags, bottle holders, extra clothing items for mother or child, pillows, etc.

The fabric panel can include a portion of resiliently flexible material that has a stiffness greater than the fabric of the panel. Referring once again to FIG. 1, the resiliently flexible material 20 can be situated along the top edge 12 of the cover 10. As illustrated, in a preferred embodiment, the resiliently flexible material can be sewn into the upper central seam area of the top edge, an area represented as the area between point 22 and point 24. The resiliently flexible material can be configured to prevent the upper edge of the panel from resting against the mother. Such configuration can be at a distance away from the mother's person so as to allow for adequate ventilation for the infant and/or can further allow the mother to view at least a portion of the infant, such as the infant's face or head. In embodiments wherein reversibility of the nursing cover is desirable, such design requires special consideration for selection and use of resiliently flexible material, as some resiliently flexible materials may form a single convexity and are resistant and/or incapable of forming a reverse convexity. In such instances, the resiliently flexible material may be optionally removed and re-positioned in the reverse position. Preferably, however, the resiliently flexible material can be capable of functioning to prevent the upper edge of the panel from resting against the mother on both the original and the reverse sides without manipulation beyond reversing the panel of fabric as a whole.

As previously mentioned, the resiliently flexible material can be sewn into at least a part of the seam of the upper edge of the panel, or a separate seam near the upper edge of the panel, as illustrated in FIG. 1. The resiliently flexible material can extend any distance from the top of the upper edge of the panel. Such resiliently flexible material can extend the full distance to the lower edge of the panel, can extend a minimal distance towards the lower edge, or can extend any distance in between. Although this embodiment may be preferred in some aspects in that it is more aesthetically pleasing, and may be more comfortable for the infant and/or mother, such configuration is not required. In fact, the resiliently flexible material can be of any size and shape and attached in any manner that can be configured to prevent the upper edge of the panel from resting against the mother. Non-limiting examples of resiliently flexible material include horsehair, boning, synthetic woven fabrics, polymeric sheets or strips, and/or may include a plurality of layers of material. In a specific embodiment, the resiliently flexible material can comprise or consist essentially of boning. In another specific embodiment, the resiliently flexible material can comprise or consist essentially of horsehair. In still another embodiment, the resiliently flexible material can be from about 2 to about 10 layers of horsehair material. In another aspect, the resiliently flexible material can also be sufficiently flexible to allow the nursing cover to be tightly folded or rolled for storage. The use of some resiliently flexible material can allow for ease in reversibility of the cover, where the resiliently flexible material does not require special manufacturing considerations or additional care beyond turning the cover to the reverse side in order to reverse the cover. This is the case with, for example, the horsehair material.

In accordance with the present invention, a nursing cover can include a neck fastening strap attached in at least one place to a central region of the upper edge of the panel. In FIG. 1, the neck fastening strap 26 is attached to the upper edge 12 of the cover 10 at point 22. The fastening strap can be configured to extend around a mother's neck and at least partially secure the panel of fabric in a position shielding the front area of the nursing mother. In one embodiment, the neck fastening strap can be substantially a flat strip of rectangular cross-section. The neck fastening strap can be of any material which can be configured to at least partially hold the cover in place. As such, the neck fastening strap can be the same or different material(s) than the panel of fabric. In one aspect, the neck fastening strap can be configured for optional and complete removal from the panel of fabric. Such design can allow for easier conversion to a blanket or other such use.

The neck fastening strap can be of any configuration which aids in holding the cover in a shielding position in for a nursing mother. As such, a variety of fastening materials can be used. A simple configuration includes two separate strips of material, each permanently or semi-permanently attached to the upper edge of the panel of fabric. The attachments can be a distance apart sufficient to allow for comfort in attaching around the neck, and can be secured by tying a fastening knot with the two strips. Further, a variety of fastening mechanisms and apparatuses can be used to attach one or two neck fastening straps in a manner that adequately covers a nursing mother. Non-limiting examples of attachments that can be used include hook and loop, rings (such as D-rings, O-rings, etc.) buckle, clamp, button, hook, magnets, snap, and various buckles. Non-limiting examples of various buckles can include any type of attachment system presently utilized to securely fasten belts, including military dress buckles, end bar buckles, parade buckles, roller buckles, stamped buckles, web strap buckles. Still another relatively simple configuration involves a permanent loop of material whereby the neck fastening strap is attached in two locations on the upper edge of the panel such that a mother can slip her head through the loop. Such configuration does not allow for variability in the size of the neck attachment, however, can be effective to hold the cover in place.

In a particular embodiment, a slide buckle can be used as the point of attachment of the neck strap. As shown in FIG. 1, a slide buckle 28 can be attached to the upper edge 12 of the panel 10. The configuration illustrated shows a small piece of material 30 attached directly to the upper edge of the panel that holds the slide buckle in a position which can facilitate attachment with the neck fastening strap 26. In such configuration, the neck fastening strap can be configured to extend around the mother's neck and snugly fit the slide buckle. Slide buckles are buckles having a continuous outer two-dimensional shape forming an open area, often a circle, ellipse, or rectangle, and having a resilient material attached to two points of the two-dimensional shape. Although not required, the resilient material often bisects the shape. A slide buckle typically works by threading a length of fabric under one portion of the two-dimensional shape, threading the fabric over the resilient material, and threading the fabric under the second portion of the two-dimensional shape. The fabric is held in place against forces to pull it out of the buckle, by the general friction caused by the snugness of the fabric against the materials of the slide buckle, as well as the snugness of the mass or quantity of fabric as compared to restricted space for the fabric along the threaded pathway. Ultimately, forces to remove a properly fitted amount of fabric from a slide buckle result in tightening the buckle, as a single force exerted on the unthreaded portion of fabric does not properly cause the fabric to move over the resilient material of the slide buckle. To attach the neck strap at the slide buckle, then, it is threaded first under the top edge (where directions are used for ease of conversation as defined in accordance to the front view as illustrated in FIG. 1). The neck strap is then threaded over the middle bar and under the lower edge of the slide buckle.

The neck strap can be adjusted in a variety of ways. The neck fastening strap can be selected to extend any distance past the slide buckle. In the example, the neck fastening strap extends past the slide buckle to have a "tail." By allowing a longer tail, the cover can be greatly adjusted to hang at various lengths and positions on the mother. As slide buckles can be secured in virtually any location along the length of the neck strap, the embodiment of a nursing cover including a slide buckle as a neck attachment mechanism allows for enormous variability, as well as continuously changing the length of the neck attachment, which can be useful during the months of nursing, or even during a single nursing event.

The slide buckle can be selected according to aesthetic and/or functionality considerations. To produce a snug fit using a slide buckle, a variety of parameters can be adjusted. The slide buckle has a center band that can be used to attach the slide buckle to a cover (e.g. shown as attached with a segment of fabric 30 of FIG. 1). It is the combination of the materials used for the slide buckle, neck fastening strap, and the material used to attach the slide buckle to the cover that can be altered in type or width so as to create an amount of friction which limits the ability of the neck fastening strap to slide out of the slide buckle.

Figure 2:
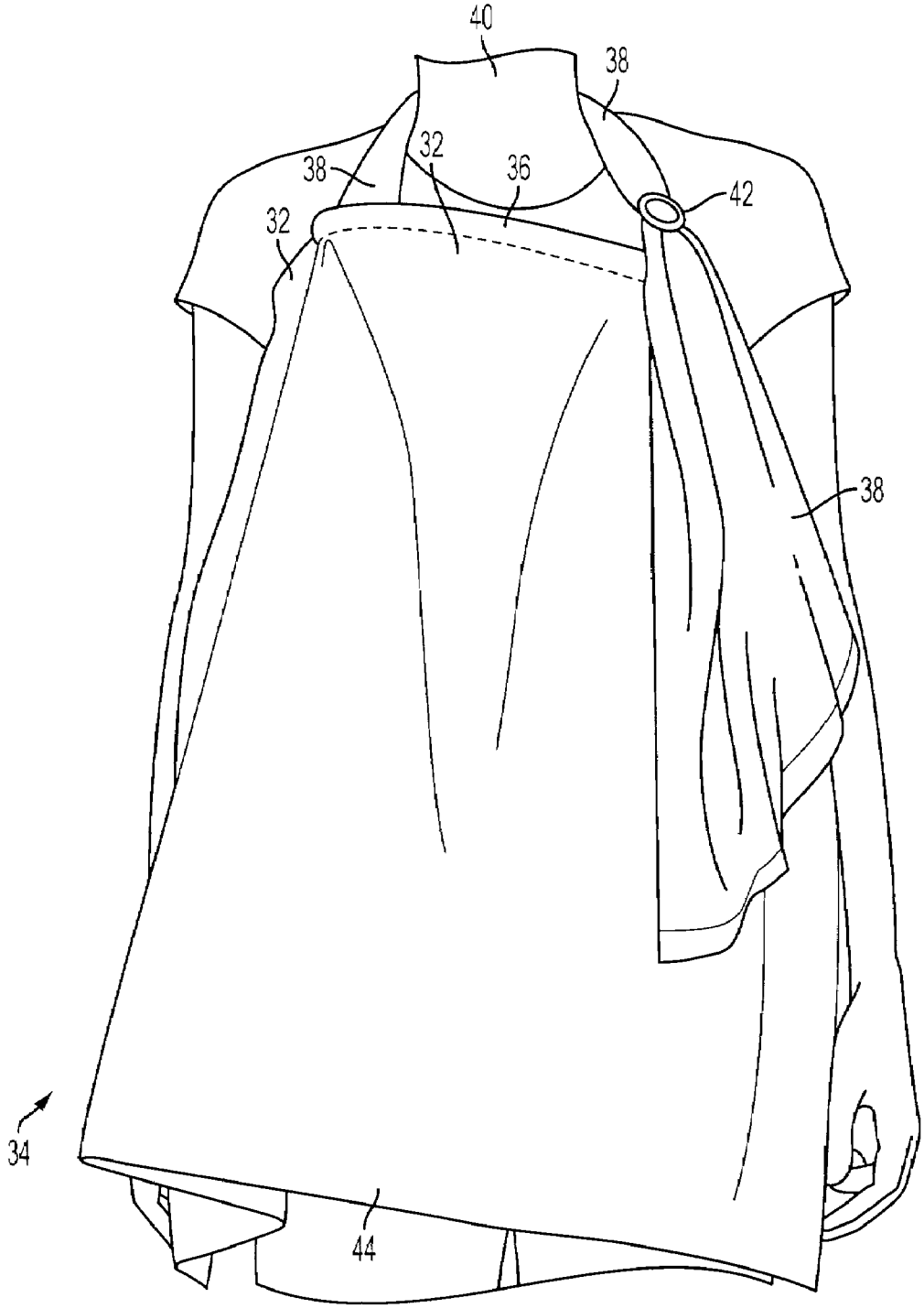
FIG. 2 is a perspective view of a nursing cover as worn on a person and arranged in an apron style, where the view is of the front of the person, in accordance with one embodiment.

A mother can wear the nursing cover in a variety of ways during nursing. In one embodiment, the cover can take what is herein referred to as an apron configuration, as illustrated in FIG. 2. As shown, the upper edge 32 of the nursing cover 34 that has the resiliently flexible material 36 near the upper edge and substantially center to the mother's chest. In the illustrated embodiment, the resiliently flexible material is the length of a majority of the width of the nursing mother's torso. Such arrangement allows for ease in allowing a mother to view her nursing infant. Additional lengths and arrangements of the flexible material along the upper edge of the nursing cover are contemplated as would be obvious to one of ordinary skill in the art. As shown, the neck fastening strap 38 extends from the front of the mother's chest, around the mother's neck 40, and attaches to the cover at a second point on the opposite side of the mother's chest. The neck strap is attached by a slide buckle 42. Such attachment allows for a nursing mother to adjust the length of the neck strap around the mother's neck to any position along the length of the neck strap. The variability allows for, e.g., adjustments due to changes during the nursing process, adjustments based on comfort, and adjustments based on desired height of the upper edge of the nursing cover. The neck strap illustrated is relatively long, however any length of neck strap could be utilized which permits for adequately securing the nursing cover to a mother, either in the apron style, i.e. neck strap extending from the front of a mother, around the back of the mother's neck, and extending again to the front of a mother, or in any other manner that effectively shields a nursing mother's breasts. FIG. 2 also illustrates additional length of the nursing cover 34, wherein the opposing side edges of the nursing cover (not substantially shown) extend around the mother's torso to the side or mother's back. The figure shows such extension under the mother's armpits and between the mother's torso and arms, however the nursing cover could optionally extend around the mother and terminate at the mother's side or could extend around to a mother's back region over or enclosing the mother's arms.

The nursing cover extends down the mother at least a length sufficient to adequately conceal any exposed breast. As illustrated in FIG. 2, the nursing cover 34 can extend such that the bottom edge 44 of the nursing cover reaches at or below the mother's hip region as measured when standing. Additional length can often provide for greater movement during and preparing for nursing without concerns about exposure. Additionally, it may be desired to tent the infant during nursing, thus substantially concealing the nursing infant, while providing adequate ventilation for the infant.

Figure 3:
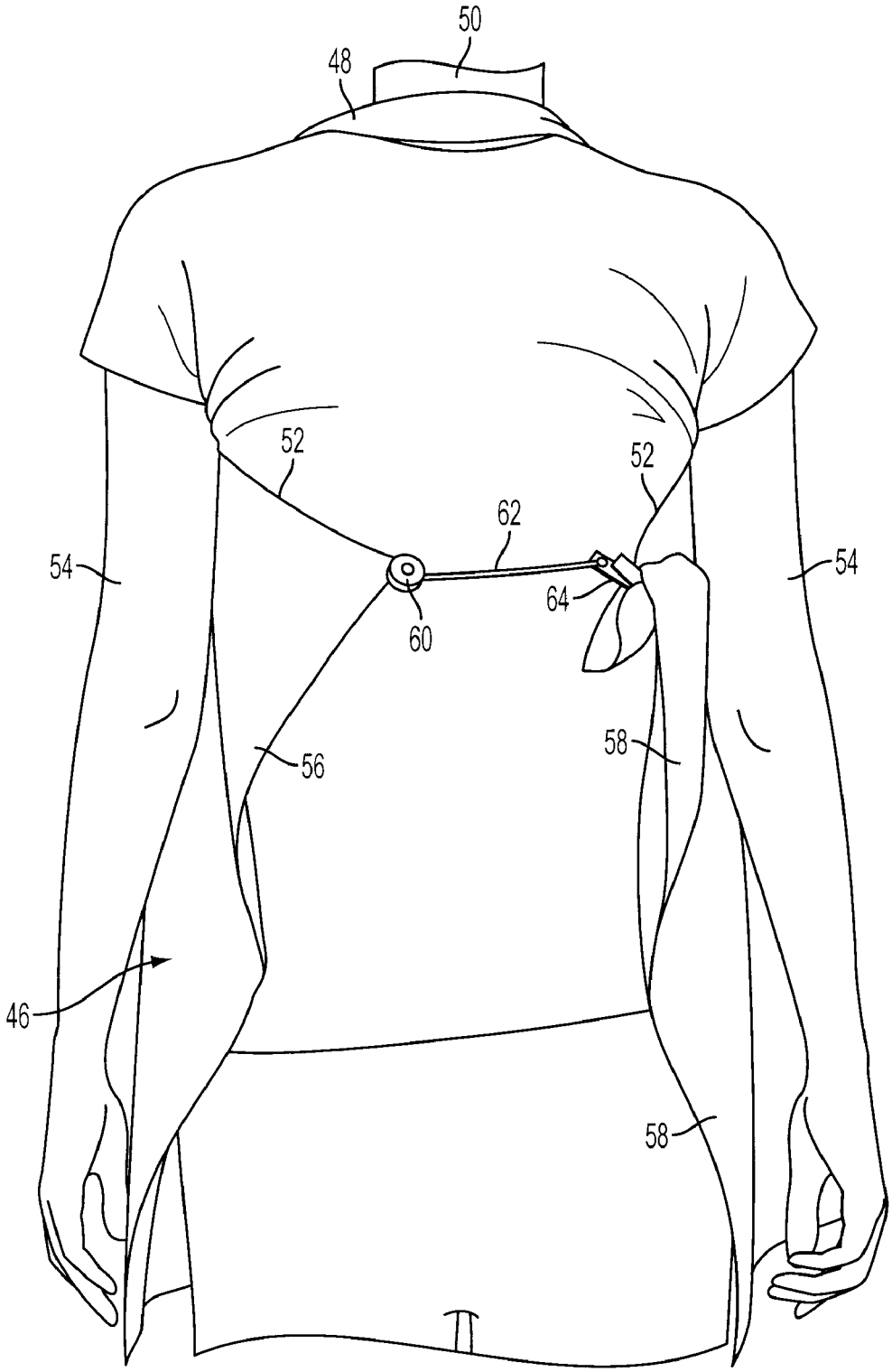
FIG. 3 is a perspective view of a nursing cover as worn on a person and shown of the back of the person, as illustrated in FIG. 2, and wherein the nursing cover includes a back attachment, in accordance with one embodiment.

In some embodiments, the nursing cover can include one or more back fastening straps. In one aspect, the back fastening strap can be optional, in other embodiments, the back fastening strap can be necessary. Such strap can be attached to the first side edge of the panel of fabric and can be configured to optionally attach to the second side edge of the panel of fabric. Any type of configuration which can attach one side of the cover to another can be used as the back fastening strap. It should be noted that a side of the cover can include a corner of a panel of fabric wherein the side edge meets the upper or lower edge of the panel of fabric. Any fastening agent can be utilized to attach the two side edges of the nursing cover. Examples of attachment mechanisms include, without limitation, those recited in connection to neck fastening straps. In one aspect, the back fastening strap can be continuously adjustable. A non-limiting example of a continuously adjustable back fastening strap is a retractable reel of the type often used with identification badges and the like. FIG. 3 illustrates the back of a nursing cover as modeled on a person in the fashion of FIG. 2. In the apron style, the nursing cover 46 is generally centered towards the front of the mother, with the neck strap 48 extending around the mother's neck 50, and attaching in two points along the top edge 52 of the nursing cover at the front of the nursing mother. The nursing cover extends around the mother's torso and under her arms 54. A back fastening apparatus can be utilized to attach opposing sides of the nursing cover. As shown, opposing sides 56 and 58 are angled towards one another near the top edge points.

The illustrated embodiment of FIG. 3 shows a retractable reel type adjustable back fastening strap. In the figure, a reel 60 is connected to a first side edge 56 in the area where the first side edge forms a point with the upper edge 52 of the cover 46. The reel has a retractable string or wire 62 which can span at least the distance of a mother's back and attach to the second side edge 58, again near the point of the upper edge 52 and the second side edge. Although the attachment point exemplified by the figure is at the side edge where the side edge forms a point or meets the upper edge, any point along the side edge can be utilized to attach a back fastening strap. The attachment in the illustration is of the form of a clamping mechanism 64, although other attachment systems are included by the present invention. As illustrated, use of a clamping mechanism can include bunching a portion of the fabric of the panel to provide for an adequate area attachment, although attachment in this manner is optional.

As discussed previously, the back fastening strap can be continuously adjustable. Continuously adjustable fastening straps are those which, while remaining securely attached to two side edges, allows for the side edges to be pulled apart or brought together, while the fastening strap remains secure and relatively or substantially taut. This feature may be desired to allow for ease in adjustments or allowances for a squirmy infant when nursing.

In one particular embodiment, the back fastening strap can be removable. Presently, the back fastening strap can fasten once the cover is at least partially situated on the mother. Therefore, a removable back fastening strap means that substantially all or at least a portion of the back fastening strap (e.g. one or both sides of the back fastening strap), can be completely disconnected from the cover. In a further embodiment, the back fastening strap can be attached to the first side edge of the cover by hook and loop. If the hook and loop is placed along a substantial part of the first side edge, or in strategic locations along the side edge, it allows for greater versatility and adjustability with the cover. Further, the attaching along the second side edge can be by hook and loop. Additionally, such attachment mechanisms can optionally be combined with each other, and can optionally include including one or more aspects of the attachment mechanisms in a seam of the side edge. In a specific embodiment, a pocket can be formed in the seam of a nursing cover wherein a retractable reel can be optionally placed and held. In another embodiment, the retractable reel can be permanently secured in a seam. Optionally, the retractable reel and/or other continuously adjustable back fastening strap can additionally attach by hook and loop or other attachment mechanism in a seam or pocket.

Figure 4:
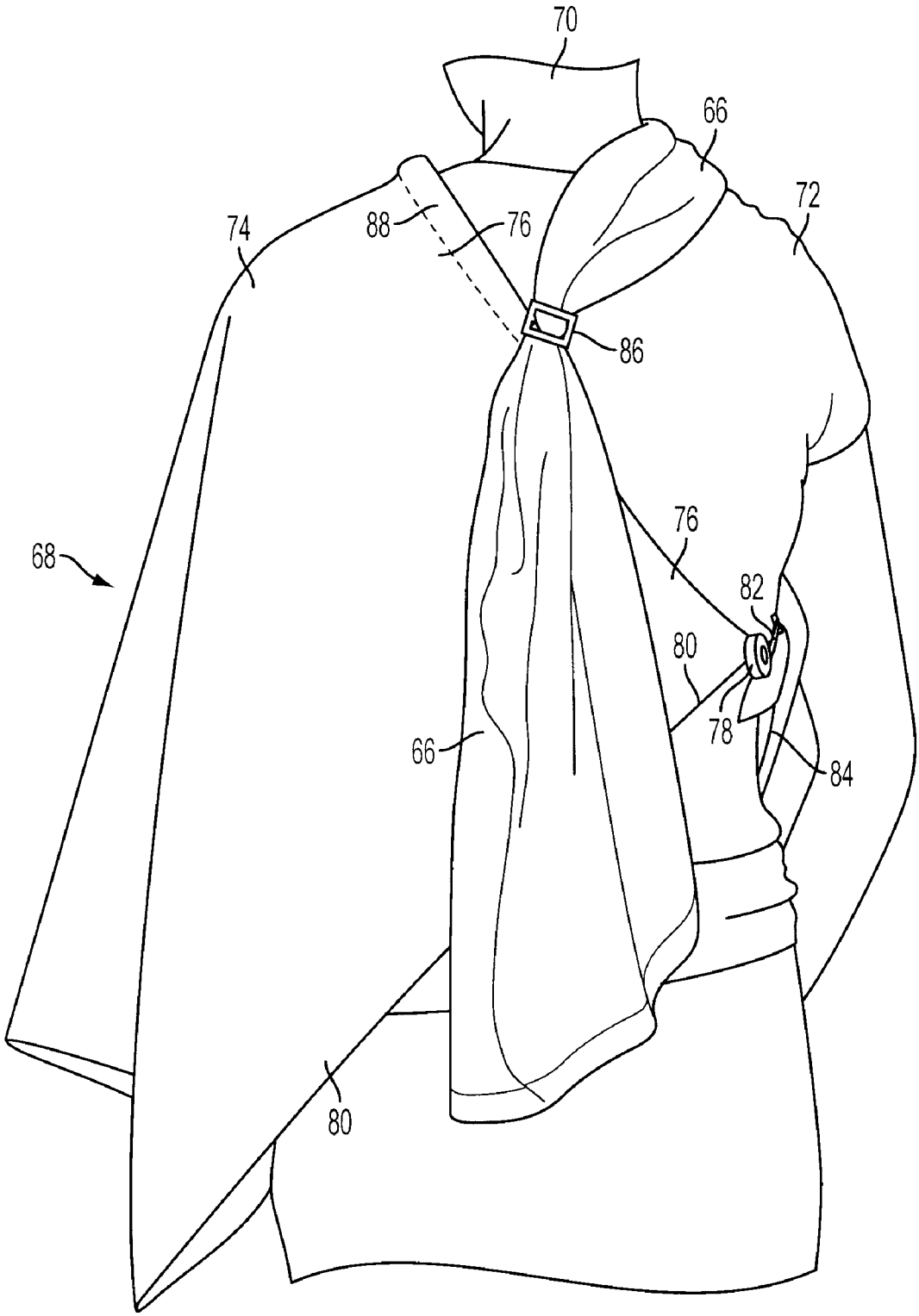
FIG. 4 is a perspective view of a nursing cover on a person and arranged in a toga style as shown of the back of the person, in accordance with one embodiment.

Another configuration for wearing the cover is in a toga-like fashion wherein the mother has the upper edge of the cover draped over her front, covering one shoulder, and along part of her back. In such case, as illustrated by FIG. 4, the neck fastening strap 66 is attached at one point to the upper edge (point of attachment not shown, as obscured by mother's chest) of the cover 68 and runs along the mother's neck 70 over the opposite shoulder 72 from the shoulder draped by the cover 74. The neck fastening strap continues around the mother's neck and attaches back to the top edge 76 of the cover on the mother's back. Also shown is a back fastening strap apparatus of the type of a retractable reel with the toga-like configuration. In the illustrated embodiment, a reel 78 is connected to a first side edge 80 in the area where the first side edge forms a point with the upper edge 76 of the cover 68. The reel has a retractable string or wire 82 which can span at least the distance of a mother's back and attach to the second side edge 84, again near the point of the upper edge 52 and the second side edge by a hook and loop attachment of a patch of fabric including loop material is inserted into the seam of side edge 84 having a corresponding patch of hook material (attachment mechanism not shown). Additionally, the side edges can be configured to attach directly to one another, via any attachment means as discussed herein.

Similar to other embodiments, FIG. 4 illustrates the neck strap 66 attached with a slide buckle 86, and a length of resiliently resistible material along the upper edge 76 of the nursing cover 68.

Depending on the materials used, the cover can be used for other purposes beyond shielding a mother and nursing infant. For example, the cover can be utilized as a blanket for the infant, a sun shade, a burp rag or any other like purpose. As the nursing cover can often be useful when a mother is in a more public atmosphere, it can be beneficial to have a nursing cover that can be configured to fold to a compact size. In one specific embodiment, the sum of the height, length, and width measurements of the folded compact folded cover can be less than about 10 inches. For example, the measurements of the compact can be 2 inches by 2 inches by 6 inches (total of 10 inches), or 2 inches by 3 inches by 5 inches (total of 10 inches). In other embodiments, the sum of the height, length, and width measurements of the folded compact folded cover can be less than about 8 inches, 11 inches, 15 inches, or even 20 inches. In one embodiment, the neck fastening strap can be used to secure the cover in a compact.

The invention further includes a method of discreetly nursing an infant which includes providing a nursing cover as disclosed herein, fastening at least one fastening strap (neck fastening strap and/or back fastening strap) and adjusting the cover to shield an upper front portion of a mother and the infant, and nursing the infant. The cover can be optionally configured in an apron, toga, or any other useful configuration as would be apparent. In the apron configuration, the panel of fabric can optionally be fitted between the mother's arms and her torso, can optionally be fitted to envelop at least a portion of the mother's arms, can be configured to substantially conceal the infant, or any combination or variation thereon.

While the invention has been described with reference to certain preferred embodiments, those skilled in the art will appreciate that various modifications, changes, omissions, and substitutions can be made without departing from the spirit of the invention. It is therefore intended that the invention be limited only by the scope of the appended claims.

What is claimed is:

1. A nursing cover for shielding the upper front portion of a mother and a nursing infant, comprising:

a panel of fabric with opposing upper and lower edges and opposing side edges and having a height and width sufficient to substantially cover at least a region from the mother's upper chest to below the mother's breasts, said panel including a portion of resiliently flexible material having a stiffness greater than the fabric and configured to prevent the upper edge of said panel from resting against the mother;

a fastener attached to the upper edge of the panel;

a neck fastening strap attached to the upper edge of the panel and located a distance away from the fastener, said fastening strap configured to extend around the mother's neck and snuggly fit the fastener; and a back fastening strap including a retractable reel attached to side edge of the panel of fabric and configured to attach to an opposing side edge of the panel of fabric.

2. The cover of claim 1, wherein the resiliently flexible material is sewn into at least part of a seam of the upper edge of the panel.

3. The cover of claim 1, wherein the resiliently flexible material is a plurality of layers of material.

4. The cover of claim 1, wherein the resiliently flexible material includes horsehair, boning, or combinations thereof.

5. The cover of claim 1, wherein the panel of fabric extends on both sides to the mother's back.

6. The cover of claim 1, wherein the neck fastening strap is a different material than the panel of fabric.

7. The cover of claim 1, wherein the back fastening strap is continuously adjustable.

8. The cover of claim 1, wherein the cover is configured to fold to a compact size wherein the sum of the height, length and width measurements of compact folded cover are less than about 10 inches.

9. The cover of claim 1, wherein the fastener includes an attachment selected from the group consisting of hook and loop, buckle, rings, clamp, button, hook, snap, a length of material attached in two locations on the upper edge of the panel, or any combination thereof.

10. The cover of claim 9, wherein the fastener includes buckle of the slide buckle type.

11. The cover of claim 1, wherein the back fastening strap is removable.

* * * * *